US007316519B2

(12) United States Patent
Ryman et al.

(10) Patent No.: US 7,316,519 B2
(45) Date of Patent: Jan. 8, 2008

(54) PAVING MEMBER

(76) Inventors: Alec Leonard Ryman, 12 Reading Road, Woodley, Nr. Reading, Berks, RG5 3DB (GB); Nicole Ann Leader, 6 Livingstone Gardens, Nr. Reading, Berks, RG5 3LT (GB)

( * ) Notice: Subject to any disclaimer, the term of this patent is extended or adjusted under 35 U.S.C. 154(b) by 0 days.

(21) Appl. No.: 10/296,930

(22) PCT Filed: May 30, 2001

(86) PCT No.: PCT/GB01/02393

§ 371 (c)(1),
(2), (4) Date: Nov. 26, 2002

(87) PCT Pub. No.: WO01/93234

PCT Pub. Date: Dec. 6, 2001

(65) Prior Publication Data

US 2003/0147694 A1 Aug. 7, 2003

(30) Foreign Application Priority Data

May 31, 2000 (GB) ..... 0013242.3

(51) Int. Cl.
*E01C 17/00* (2006.01)
*E01C 5/00* (2006.01)

(52) U.S. Cl. ..... 404/22; 404/17; 404/18; 404/19; 404/23; 404/34; 404/35; 404/36

(58) Field of Classification Search ..... 404/12–16, 404/34–36, 43, 40, 22, 17–19, 23; 405/303; 705/15

See application file for complete search history.

(56) References Cited

U.S. PATENT DOCUMENTS

| | | | | | |
|---|---|---|---|---|---|
| 640,140 | A | | 12/1899 | Lloyd | |
| 4,509,837 | A | * | 4/1985 | Kassies | 353/10 |
| 4,779,324 | A | * | 10/1988 | Sandor, Sr. | 29/451 |
| 5,154,533 | A | * | 10/1992 | Baldea | 404/1 |
| 5,418,584 | A | * | 5/1995 | Larson | 353/122 |
| 5,457,561 | A | * | 10/1995 | Taneya et al. | 398/120 |
| 5,507,600 | A | * | 4/1996 | Takahashi | 405/303 |
| 5,681,105 | A | * | 10/1997 | Nau | 362/153 |
| 5,726,806 | A | * | 3/1998 | Holden et al. | 359/630 |
| 5,816,737 | A | * | 10/1998 | Siblik | 404/13 |
| 6,027,280 | A | * | 2/2000 | Conners et al. | 404/19 |
| 6,082,886 | A | * | 7/2000 | Stanford | 362/576 |

(Continued)

FOREIGN PATENT DOCUMENTS

FR 2 667 717 A 4/1992

(Continued)

*Primary Examiner*—Raymond W Addie
(74) *Attorney, Agent, or Firm*—Iandiorio & Teska

(57) ABSTRACT

A paving member (2) comprising a surface (4) for being walked on, an image (6) below the surface (4), and a source of light for illuminating the paving member (2), the paving member (2) being of such a material and construction that the image (6) is viewable by a person walking on the surface (4), and the source of light being such that it makes the image (6) visible at night and also provides light at night for the environment (8) adjacent the paving member (2). The image may be a static image or a moving image. The image may be a hologram. The image may be changed by remote control means.

13 Claims, 6 Drawing Sheets

U.S. PATENT DOCUMENTS

| | | | | |
|---|---|---|---|---|
| 6,171,015 | B1 * | 1/2001 | Barth et al. | 404/34 |
| 6,219,876 | B1 | 4/2001 | Blum | |
| 6,305,874 | B1 * | 10/2001 | Custers et al. | 404/9 |
| 6,353,489 | B1 * | 3/2002 | Popovich et al. | 359/15 |
| 6,417,778 | B2 | 7/2002 | Blum et al. | |
| 6,484,148 | B1 * | 11/2002 | Boyd | 705/14 |
| 6,507,285 | B2 | 1/2003 | Blum et al. | |

FOREIGN PATENT DOCUMENTS

| | | | |
|---|---|---|---|
| GB | 2 040 534 | A | 8/1980 |
| GB | 2 336 932 | A | 3/1999 |
| WO | WO 98 03956 | A | 1/1998 |

* cited by examiner

PAVING MEMBER

FIELD OF THE INVENTION

This invention relates to a paving member such for example as a paving slab or a paving block. The paving member may be used in a wide variety of places including paved, blocked and tarmaced areas.

BACKGROUND OF THE INVENTION

Places that are subject to a lot of pedestrian traffic include pavements, walkways, recreational areas, patios, shopping malls, and areas in supermarkets and hypermarkets. There are often occasions at night when these places could be better lit, for example public and private spaces.

SUMMARY OF THE INVENTION

It is an aim of the present invention to obviate or reduce the above mentioned problem whilst at the same time providing the opportunity for the minimisation of expense of the cost of lighting.

Accordingly, the present invention provides a paving member which is installed in a hole in an area which is for being walked on, the hole being defined by adjacent edges of the area, the paving member being such that it is flush with the adjacent edges of the area, and the paving member being such that it comprises a tray-shaped rigid body portion which has four sides and a base and which enables a person to walk on the paving member in the hole, a lip which extends outwardly from the four sides and is located in a countersunk part of said adjacent edges of said area wherein said lip is level with said adjacent edges, securing means which permanently secures the paving member in a horizontal position in the hole, a surface for being walked on and which extends horizontally in the hole at a height which makes the surface level with the area for being walked on wherein a person is able to walk over the paving member and the area for being walked on without tripping, image-generating means which generates a moving image below the surface, and a source of light which illuminates the paving member, the paving member being such that the surface is made of a material which is transparent wherein the image is able to be viewed by the person walking on the surface, the moving image is viewed by the person through a major part of the surface, the image-generating means generates the moving image on a screen positioned below the surface, the screen is spaced apart from the surface wherein cooling air is able to circulate between the screen and the surface, and the screen is selected from the group consisting of a television screen, a liquid crystal display screen, a light emitting diode screen, a plasma screen, a laser-receiving screen, or a projection screen wherein the moving image viewed on the screen is a film, video or televisual image.

The paving member of the present invention is thus able to provide light at night for the environment adjacent the paving member so that the paving member and its surroundings may easily be seen. In cases where the image below the surface of the paving member is an advertising image, then there is an advantageous opportunity for organisations doing the advertising to pay for the lighting. Thus, in the case of paved areas open to the public and maintained by local Councils or the like, the local Councils or the like can avoid or reduce the cost of lighting these areas by selling advertising space in the public areas to organisations who firstly wish to advertise and who secondly will pay for the electricity involved in powering the light source. Thus the present invention affords the opportunity for lighting paved areas at reduced or no cost to local Councils or similar organisations. In addition, the present invention affords the opportunity for the paved areas to be better lit than they would otherwise be, which provides a significant advantage to members of the public using the paved areas. For example, the number of people accidentally tripping over or being mugged may be drastically reduced in well lit areas as opposed to dark areas.

The image is a moving image. The moving image may be a hologram moving image. The holographic image may be recorded in an emulsion on the surface of a film or glass plate. Two laser light sources (the object beam and the reference beam) may interact at the point at which they meet creating an interference pattern which freezes the information carried by the object beam, thereby forming the holographic image.

The paving member may be linked to remote control means for remotely changing the image. The paving member and the remote control means may then form part of a system, for example an advertising system. Where there is more than one paving member, the images on the paving members may be controlled singly, in a series, or in a group.

The transparent material may be a transparent plastics material. The transparent plastics material may be a clear polyacrylate or any other suitable and appropriate transparent plastics material. The transparent material may alternatively be glass.

Advantageously, the surface of the paving member is a slip retardant surface.

The moving image is obtained by using a television screen, a liquid crystal display screen, a light emitting diode screen, a plasma screen, a laser-receiving screen, or a projection screen. Images on the screen can be under the control of a central control. Thus, for example, a central control from an advertising agency, or the head office of Tesco's, could be directly or indirectly connected to the screen, by using electronic means, radio signals, a telephone cable etc. By having this facility, it would no longer be necessary for a person to physically visit the paving the member each time a new image, for example for a new advertising promotion, was required to be shown.

The moving hologram image may appear to rise out of the floor.

The moving image may be chosen to coincide with any advertising campaign currently running.

The image may be viewable from different directions, both during the day and at night.

The paving member may be one in which there is more than one of the images. The different images may be viewable from different directions. The paving member may be regarded as a screen with the images showing on the screen. The paving member may be a moulded paving member, or it may be made in other ways if desired.

The paving member may be one in which the surface of the paving member is the upper surface of a sheet portion. The sheet portion may have a pair of opposed side walls for supporting the sheet portion above the ground. The image may then be on an underneath surface of the sheet portion.

The underneath surface of the sheet portion may be provided with ridges. The paving member may then be one in which the ridges have first and second flat sides, and in which a first image is viewable on the first sides, and a second image is viewable on the second sides.

The paving member of the present invention may be one which is constructed as a paving member for use in pavements. The source of light may direct light away from a road bordered by the paving member. Such a construction is advantageous in that traffic using the road will then not be confused with the light from the pavement. If desired, the source of light in the paving member may be masked or otherwise shielded in order that light is not directed to unwanted places.

The source of the light may be a light emitting diode, a neon strip light, or a bulb. More than one source of light may be employed if desired.

The body portion may be in the form of a tray or a frame. The body portion may be made of any suitable and appropriate materials including metals such for example as pressed steel, stainless steel or galvanised steel. The body portion may receive the remainder of the paving member which may be appropriately located in the body portion, for example using a rubber seal.

The securing means helps to stop the paving member becoming loose during use, or being deliberately removed by vandals. Any suitable type of securing means may be employed, for example a spike. Formations such as those employed to retain "cats eyes" in the ground may also be used.

The paving member of the present invention may be made of any suitable size and shape. Thus, for example, the paving member may be rectangular, square or octagonal. The paving member may be in the form of paving slabs or paving blocks.

BRIEF DESCRIPTION OF THE DRAWINGS

Embodiments of the invention will now be described solely by way of example and with reference to the accompanying drawings in which.

DETAILED DESCRIPTION OF THE DRAWINGS

Figure 1:
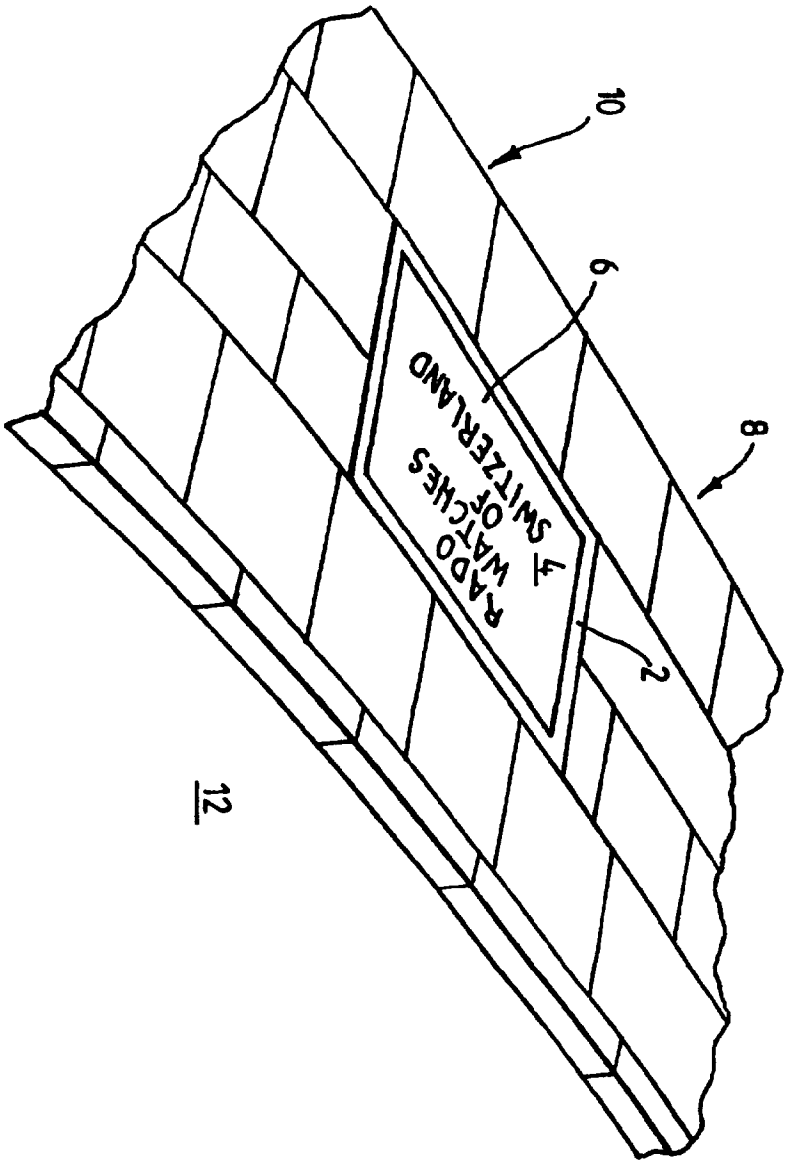
FIG. 1 is a perspective view of a first paving member in use.

Referring to FIG. 1, there is shown a paving member 2 comprising a surface 4 for being walked on. An image 6 is below the surface 4. A source of light (not shown) is provided for illuminating the paving member 2.

The paving member is of such a material and construction that the image is viewable by a person walking on the surface 4. More specifically, the paving member 2 is made of a moulded transparent plastics material. Alternatively the paving member 2 may be moulded from transparent glass. The light source is such that it makes the image 6 visible at night, and also provides light at night for the environment 8 adjacent the paving member 2. As can be seen from FIG. 1, the paving member 2 is positioned in a pavement 10 running along the side of a road 12. Thus the source of light is able to illuminate the environment 8 around the paving member 2, which environment 8 can include the pavement 10 around the paving member 2.

The paving member 2 has significant advantages. Firstly, the paving member 2 is able to light up the pavement 10 around the paving member 2. Persons walking along the pavement 10 are thus able to walk at night in more safety than would be the case if lighting were not provided. For example, persons walking at night with good visibility are less likely to trip over or otherwise have an accident. The persons are also less likely to be mugged in well lit areas than in dark areas. A second advantage of the paving member 2 is one of a cost saving. More specifically, local Councils traditionally pay for the cost of lighting pavements. This is expensive since there are so many pavements. In the present case, the image 6 is advertising material as can be seen from FIG. 1. The firm benefiting from the advertising material can be caused to pay for the cost of the lighting, and if desired, the cost of installing the paving member 2. Thus local Councils or other organisations are able to obtain free of charge lighting for areas used by the public. A third advantage of the paving member 2 is that manufacturers and merchants are able to obtain a novel form of advertising at low cost. A fourth advantage of the paving member 2 is that members of the public are able to benefit from well lit areas that might otherwise not be lit. Also, the member of the public are also able to benefit from seeing whatever images are in the paving member 2.

The surface 4 is a non-slip surface in order to ensure that persons do not slip on the paving member 2. The non-slip surface may be a rough or other appropriate type of surface. The image 6 is a static image which is formed as part of the paving member 2.

Figure 2:
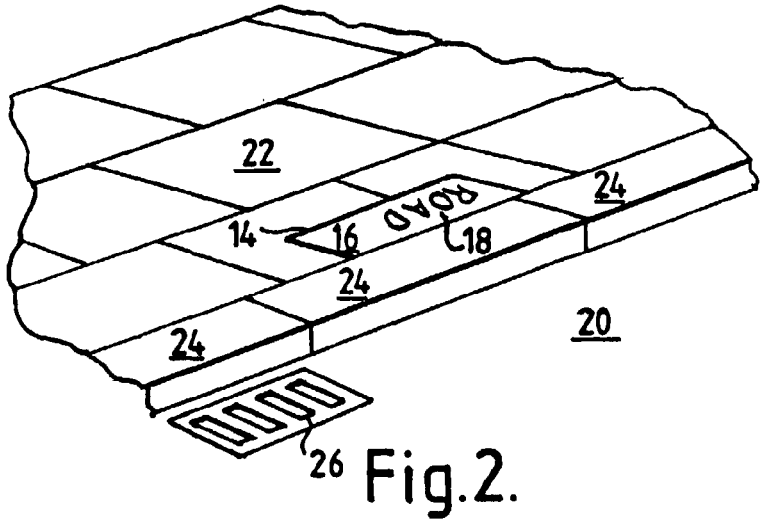
FIG. 2 is a perspective view of a second paving member in use.

FIG. 2 shows a paving member 14 with a surface 16 for being walked on, and also with an image 18 which as shown is the word "road". Thus the paving member 14 can be used to warn persons that a road 20 is being approached. The paving member 14 is placed on the edge of a pavement 22 adjacent kerb stones 24. The road 20 is provided with a drain 26 as shown.

Figure 3:
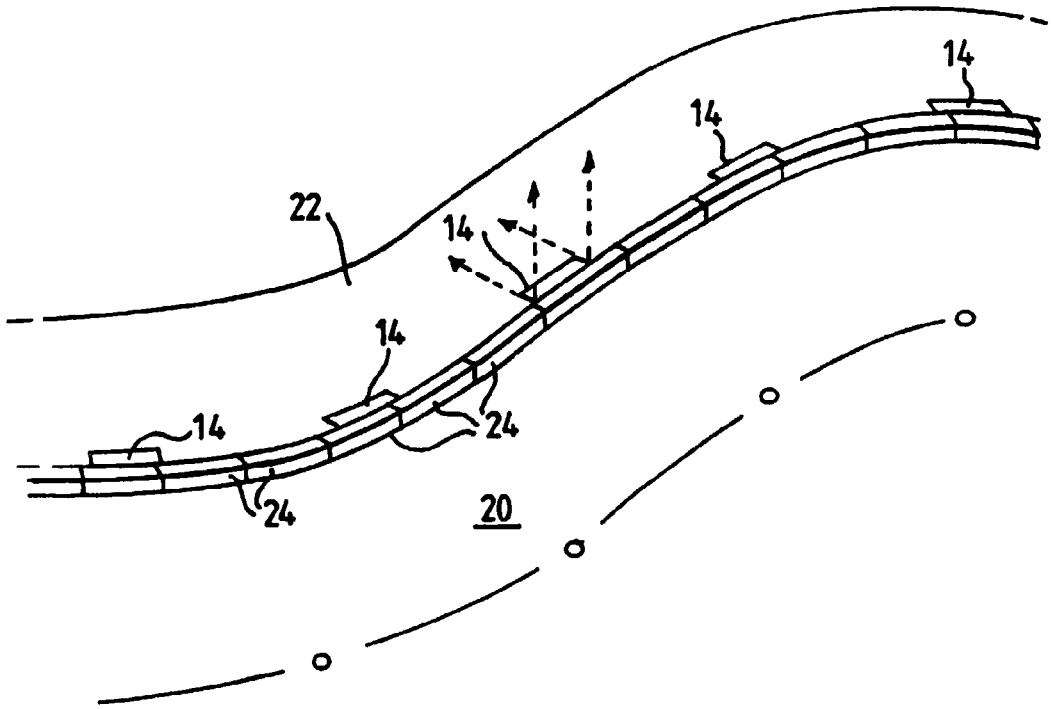
FIG. 3 is a perspective view of a third paving member in use.

FIG. 3 shows several of the paving members 14 installed on a pavement 22. The pavement 22 can be made of paving slabs as shown in FIG. 2 or it can be made of tarmac as shown in FIG. 3. As shown, all of the paving members 14 in FIG. 3 are adjacent the kerb stones 24 in order to warn people on the pavement 22 where the road 20 is. As shown in FIG. 3, the light from the source of light is arranged to shine upwardly and inwardly but not outwardly on to the road 20. This can thus avoid the possibility of drivers on the road 20 being confused by light from the paving members 14.

Where the paving member 14 has an image 18 showing the word ROAD as in FIG. 2, it will be apparent that the image 18 is not advertising material. The image 18 is basically road safety material. In this case, local Councils or other organisations would probably pay for the cost of the lighting as part of their road safety budget. For example it could be used for public safety in airports, railway stations, shopping malls, cinemas etc.

Figure 4:
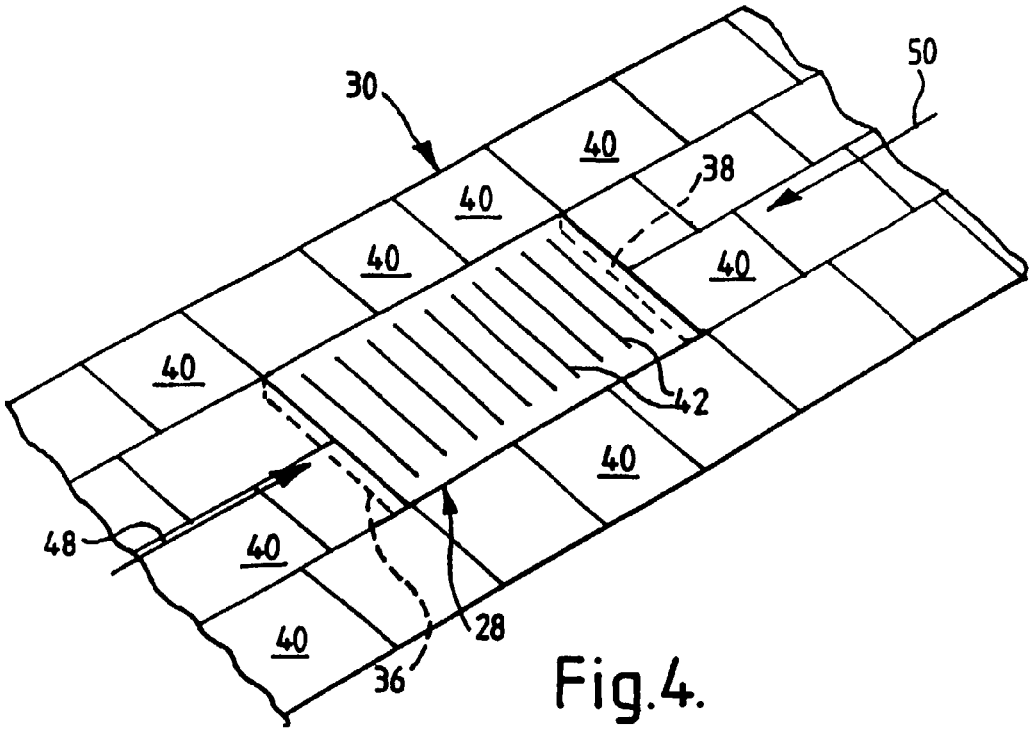
FIG. 4 is a perspective view of a fourth paving member in use.
Figure 5:
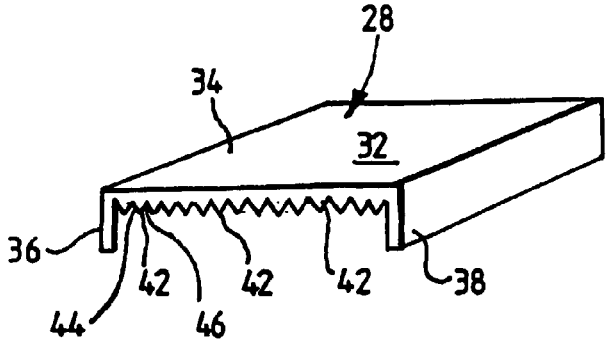
FIG. 5 is a perspective view of the fourth paving member shown in FIG. 4.

FIG. 4 shows a paving member 28 in a pavement 30. The paving member 28 is of a construction which is best seen from FIG. 5. More specifically, the paving member 28 has a surface 32 for being walked on. This surface 32 is the upper surface of a sheet portion 34. The sheet portion 34 has a pair of opposed side walls 36, 38 for supporting the sheet portion 34 above the ground. The side walls 36, 38 are such that the surface 32 is level with the upper surface of paving slabs 40 forming the pavement 30.

The paving member 28 is such that it has two of the images. More specifically, the underneath surface of the sheet portion 34 is provided with ridges 42. Each ridge 42 has one flat side 44 which faces the side wall 36, and one flat side 46 which faces the side wall 38. All or the majority of the sides 44 contain parts of a first image. All or the majority of the sides 46 contain parts of a second image. When the paving member 28 is viewed from the direction of the arrow 48, then the first image on the sides 44 are able to be seen. When the paving member 28 is viewed from the direction of the arrow 50, then the second image on the sides 46 is able to be seen. Thus the paving member 28 is able to have two separate images which are viewable when the paving member 28 is approached from different directions, that is from the directions of the arrows 48 and 50.

Figure 6:
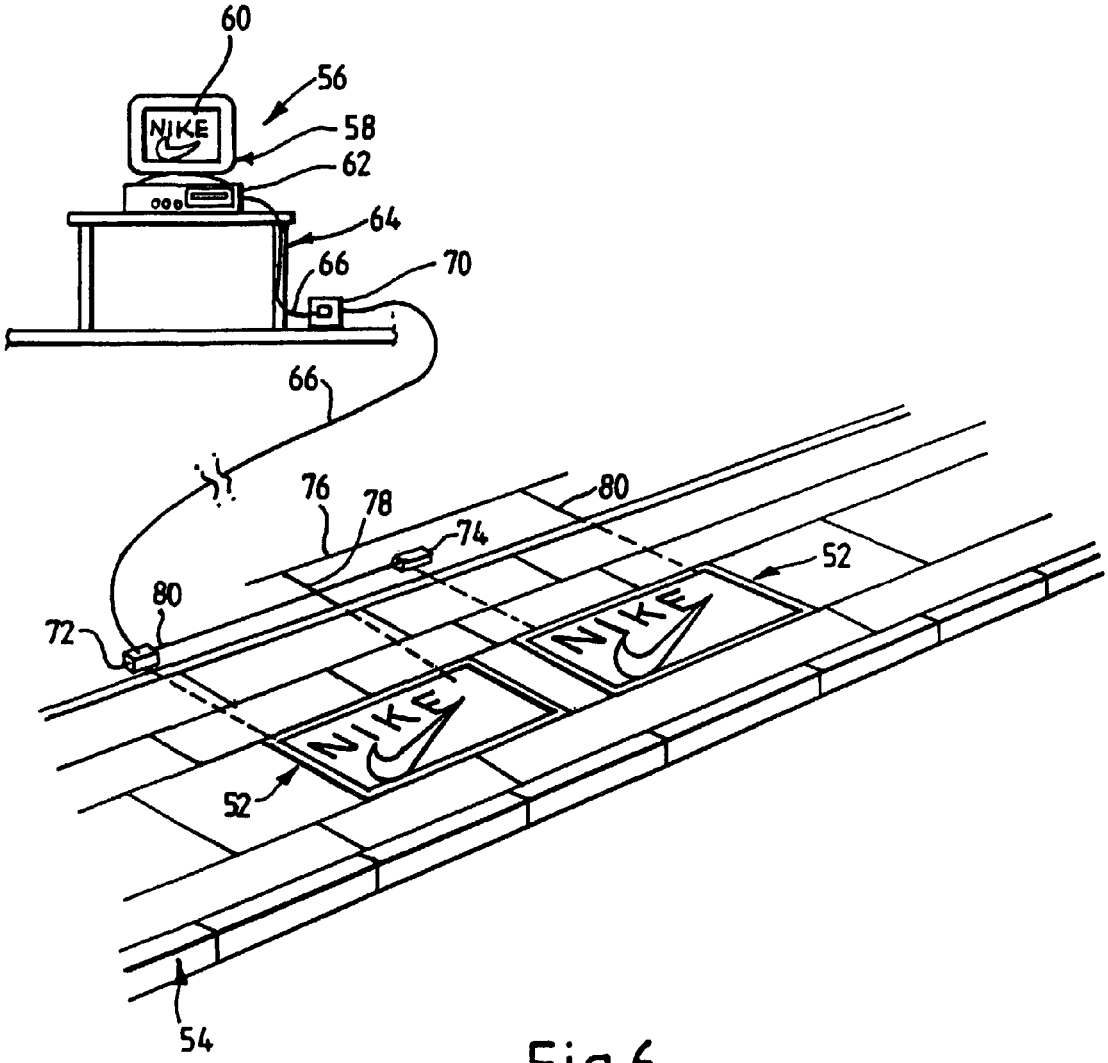
FIG. 6 shows an advertising system in which several paving members are connected to remote control means linked to the paving members via a cable connection.

FIG. 6 shows two paving members 52 with advertising material in the form of advertising material of NIKE®, Inc., including logos and designs. The paving members 52 are set in a pavement 54. Control means 56 is employed for controlling the advertising material on the paving members 52. The control means 56 comprises a computer 58 having a screen 60 which shows the advertising material on the paving members 52. The computer 58 also has a control box 62 which is mounted on a table 64 and which is connected via cables 66 and connection boxes 70, 72, 74 to the paving members 52. Also shown in FIG. 6 are underground power cables 76, 78, 80.

The control means 56 is able to provide moving or still images, for example for an advertising campaign. The moving or still images are programmed into the computer 58, for example using any suitable and appropriate means such as a digital versatile disc or the Internet. The programmed images are then transmitted along the cable 66 to the paving members 52.

Figure 7:
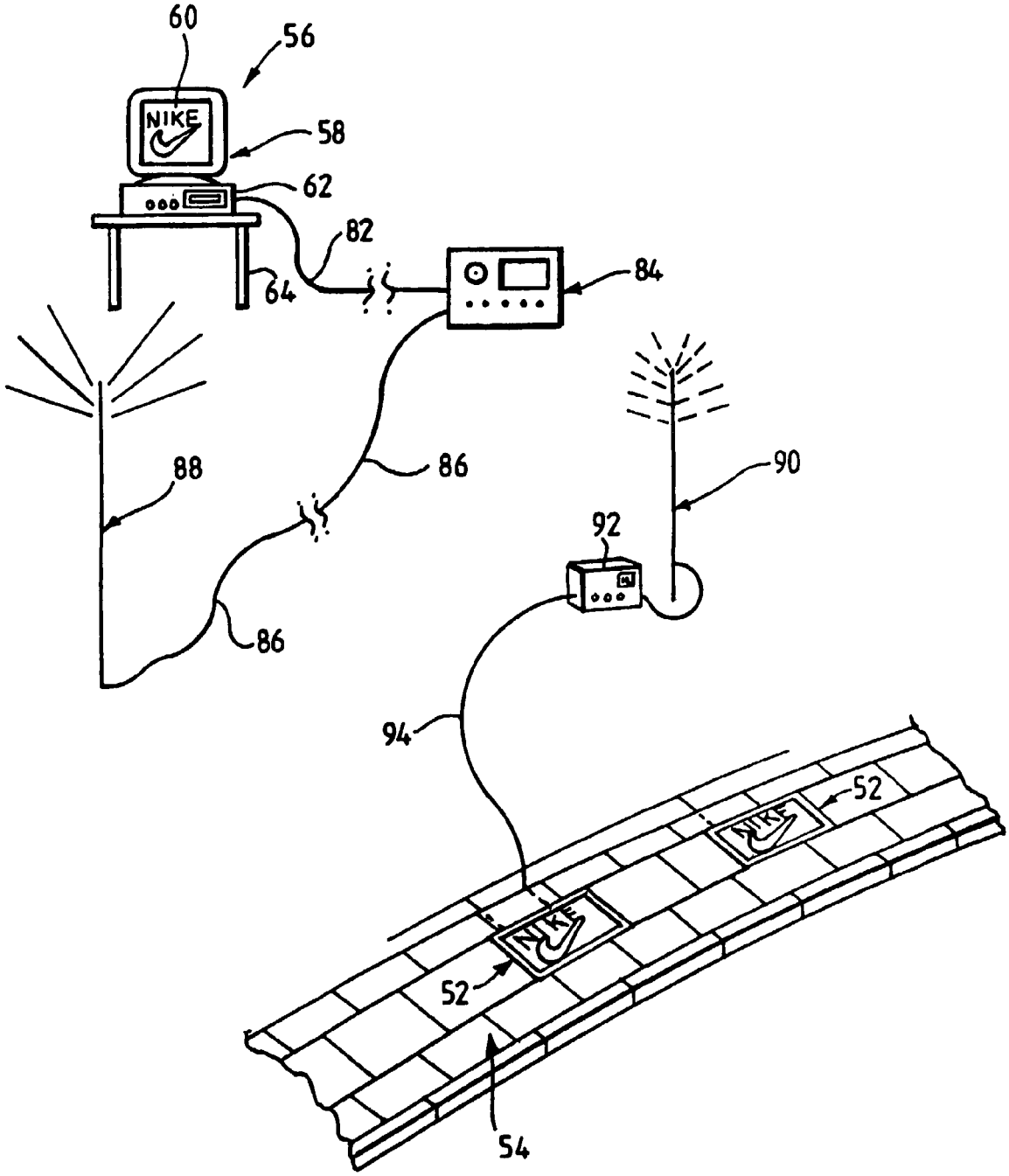
FIG. 7 is a system similar to FIG. 6 except that the connection from the remote control means to the paving members is a radio connection.

FIG. 7 shows a similar system to that shown in FIG. 6. Similar parts have been given the same reference numerals for ease of comparison and understanding. In FIG. 7, a cable 82 from the computer 58 leads to a transmitter 84. The transmitter 84 is connected by a cable 86 to a transmitter aerial 88. Appropriate signals are thus transmitted from the transmitter aerial 88 to a receiver aerial 90. Signals received by the receiver aerial 90 are transmitted to a receiver 92 which then relays the signals along a cable 94 such that the required advertising images are shown in the paving members 52.

In FIGS. 6 and 7 the images can be controlled singly, in a series, or in a group (i.e. a block).

Figure 8:
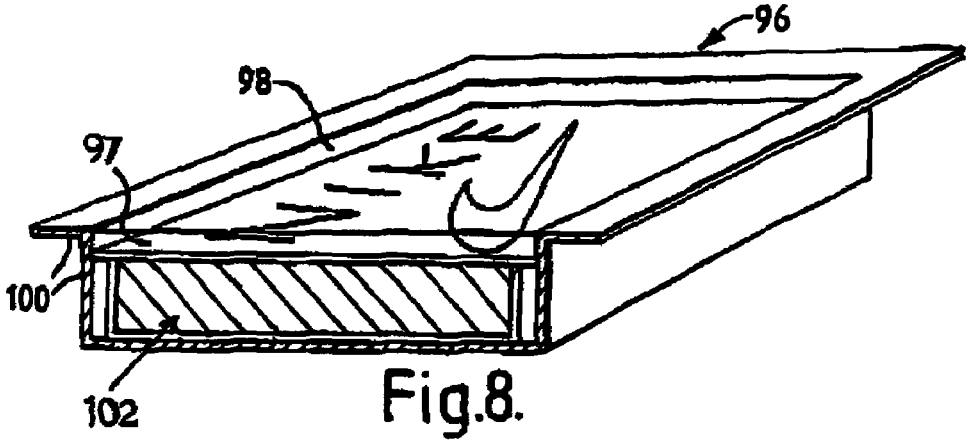
FIG. 8 is a perspective view, partly in section, of a paving member of the present invention suitable for having a moving screen.

FIG. 8 shows a paving member 96 with an image which is in the form of advertising for NIKE®, Inc., including logos and designs, but which could be any suitable and appropriate type of image. The image may be a moving or still image. The image is formed on a screen 97 which is positioned underneath a screen 98. The screen 98 may be a glass or a plastics screen 98. Seals 100 are employed as shown. The paving member 96 has image generating means 102 which includes the screen 97. The image generating means 102 is a light emitting diode device, a liquid crystal display device, a plasma device, or a conventional television screen device.

Figure 9:
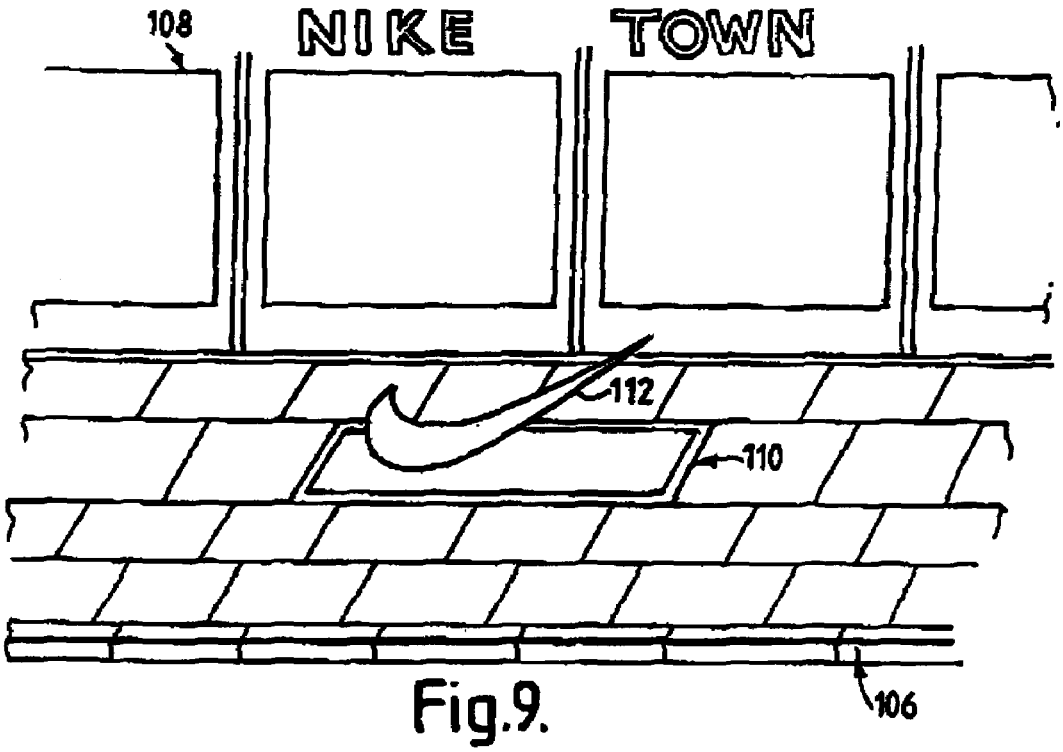
FIG. 9 shows a pavement with a paving member of the present invention, the paving member having an image in the form of a hologram.

FIG. 9 shows a pavement 106 in front of an advertising display 108 for a NIKETOWN® retail store. The pavement 106 has a paving member 110 with the NIKE® tick 112 logo of NIKE® Inc. in the form of a hologram. The hologram extends horizontally along the pavement 106. Any suitable and appropriate type of image may replace the image 112. Thus, for example, the image can be changed in dependence upon a particular type of advertising campaign.

Figure 10:
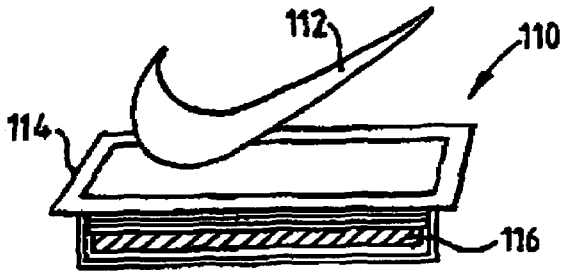
FIG. 10 shows in more detail the paving member shown in FIG. 9.

FIG. 10 shows in more detail the paving member 110 shown in FIG. 9. As can be seen, the paving member 110 has a frame 114 containing a laser box 116. The laser box 116 enables the image in the form of the Nike tick 112 or any other suitable and appropriate image to be lasered.

It is to be appreciated that the embodiments of the invention described above with reference to the accompanying drawings have been given by way of example only and that modifications may be effected. Thus, for example, the or each image may be any suitable and appropriate type of image. The image may be composed of words and/or pictures and/or numbers. The words may be in a single language or in several languages. The images may be provided in the paving member of the present invention by any suitable and appropriate means including placing appropriate images in the paving member during moulding, or printing after the paving member has otherwise been produced. The paving member may be made from any suitable and appropriate materials. The materials will usually be totally transparent but, if desired, opaque and/or transluscent portions may be employed. Much depends upon the type of imaging used because the light from the source of light can be arranged to shine through transparent or translucent images, or around opaque images. Either way the images will be illuminated and will thus be visible. Any suitable and appropriate source of light may be employed. The or each source of light may be employed in the paving member may be provided with appropriate shields or reflectors to shield or reflect the light as may be desired. The paving member can be of any suitable and appropriate size and shape so that, if desired, the paving member may be provided with more than four sides. The paving member can be located in position in the same way that surrounding paving members are located in position. If desired, two or more of the paving members of the present invention can be used together to create a larger effect than would be attainable with just one paving member of the invention.

The invention claimed is:

1. A paving member which is installed in a hole in an area which is for being walked on, the hole being defined by adjacent edges of the area, the paving member being such that it is flush with the adjacent edges of the area, and the paving member being such that it comprises a tray-shaped rigid body portion which has four sides and a base and which enables a person to walk on the paving member in the hole, a lip which extends outwardly from the four sides and is located in a countersunk part of said adjacent edges of said area wherein said lip is level with said adjacent edges, securing means which permanently secures the paving member in a horizontal position in the hole, a surface for being walked on and which extends horizontally in the hole at a height which makes the surface level with the area for being walked on wherein a person is able to walk over the paving member and the area for being walked on without tripping, image-generating means which generates a moving image below the surface, and a source of light which illuminates the paving member, the paving member being such that the surface is made of a material which is transparent wherein the image is able to be viewed by the person walking on the surface, the moving image is viewed by the person through a major part of the surface, the image-generating means generates the moving image on a screen positioned below the surface, the screen is spaced apart from the surface wherein cooling air is able to circulate between the screen and the surface, and the screen is selected from the group consisting of a television screen, a liquid crystal display screen, a light emitting diode screen, a plasma screen, a laser-receiving screen, or a projection screen wherein the moving image viewed on the screen is a film, video or televisual image.

2. A paving member according to claim 1 in which the moving image is a hologram moving image.

3. A paving member according to claim 1 in which the transparent material is a transparent plastics material.

4. A paving member according to claim 3 in which the transparent plastics material is a clear polyacrylate material.

5. A paving member according to claim 1 in which the transparent material is glass.

6. A paving member according to claim 1 in which the surface of the paving member is a slip-retardant surface.

7. A paving member according to claim 1 in which the surface of the paving member is the upper surface of a sheet portion.

8. A paving member according to claim 7 in which the underneath surface of the sheet portion is provided with ridges.

9. A paving member according to claim 8 in which the ridges have first and second flat sides, and in which a first image is viewable on the first sides, and a second image is viewable on the second sides.

10. A paving member according to claim 1 in which the paving member is constructed as a paving member for use in pavements.

11. A paving member according to claim 1 and which is linked to remote control means for remotely changing the moving image.

12. A paving member according to claim 1 in which the image generating means is spaced apart the sides of the body portion.

13. A paving member according to claim 12 in which the image generating means is spaced apart from the base of the body portion.

* * * * *